US006076511A

United States Patent [19]

Grimm et al.

[11] Patent Number: 6,076,511

[45] Date of Patent: Jun. 20, 2000

[54] REPEATER LAUNCHER AND RING AIRFOIL

[75] Inventors: Thomas H. Grimm, St. Helena; Arturo Meuniot, San Francisco; William S. Law, Palo Alto; Christopher Fruhauf, San Fracisco; Arne Lang-Ree, Los Gatos, all of Calif.

[73] Assignee: OddzOn, Pawtucket, R.I.

[21] Appl. No.: 09/245,007

[22] Filed: Feb. 4, 1999

[51] Int. Cl.[7] ..... F41B 7/00

[52] U.S. Cl. ..... 124/16; 124/81

[58] Field of Search ..... 124/16, 17, 20.1, 124/81; 446/34, 48; 473/589

[56] References Cited

U.S. PATENT DOCUMENTS

| | | | |
|---|---|---|---|
| D. 279,492 | 7/1985 | Eddins et al. | D21/89 |
| D. 337,796 | 7/1993 | Sutyak | D21/145 |
| D. 360,439 | 7/1995 | Lewinski | D21/147 |
| D. 360,914 | 8/1995 | Brown | D21/147 |
| D. 361,105 | 8/1995 | Griffin | D21/147 |
| D. 368,280 | 3/1996 | Brown | D21/3 |
| 2,474,054 | 6/1949 | Jones | 124/32 |
| 2,784,711 | 3/1957 | Vaughn . | |
| 3,232,285 | 2/1966 | Rasner | 124/21 |
| 3,264,776 | 8/1966 | Morrow . | |
| 3,877,383 | 4/1975 | Flautau | 102/93 |
| 3,898,932 | 8/1975 | Flatau et al. | 102/66 |
| 3,951,070 | 4/1976 | Flatau et al. | 102/92.4 |
| 3,982,489 | 9/1976 | Flatau et al. | 102/92.4 |
| 4,003,574 | 1/1977 | MacDonald et al. . | |
| 4,151,674 | 5/1979 | Klahn et al. . | |
| 4,154,012 | 5/1979 | Miller | 42/1 F |
| 4,246,721 | 1/1981 | Bowers . | |
| 4,291,663 | 9/1981 | Buck et al. | 124/26 |
| 4,390,148 | 6/1983 | Cudmore | 244/19 |
| 4,560,358 | 12/1985 | Adler | 446/46 |
| 4,737,128 | 4/1988 | Moormann et al. | 446/46 |
| 4,790,788 | 12/1988 | Hill | 446/61 |
| 4,820,230 | 4/1989 | Richards | 446/48 |
| 4,892,081 | 1/1990 | Moormann | 124/65 |
| 4,957,092 | 9/1990 | Rhodes | 124/20.1 |
| 5,050,575 | 9/1991 | Killion . | |
| 5,113,842 | 5/1992 | Moormann | 124/20.1 |
| 5,115,794 | 5/1992 | Moormann | 124/65 |
| 5,213,089 | 5/1993 | DeLuca | 124/29 |
| 5,224,464 | 7/1993 | Burnham et al. | 124/67 |
| 5,224,701 | 7/1993 | Sciarillo et al. . | |
| 5,254,077 | 10/1993 | Nottingham et al. | 446/48 |
| 5,259,360 | 11/1993 | Panara et al. | 124/50 |
| 5,267,549 | 12/1993 | Webber | 124/65 |
| 5,377,656 | 1/1995 | Lewinski et al. | 124/65 |
| 5,397,261 | 3/1995 | Malewicki et al. | 446/71 |
| 5,438,972 | 8/1995 | Harbin | 124/27 |
| 5,447,144 | 9/1995 | Ivy | 124/26 |
| 5,531,210 | 7/1996 | Meiser et al. | 124/66 |
| 5,535,729 | 7/1996 | Griffin et al. | 124/66 |
| 5,611,322 | 3/1997 | Matsuzaki et al. | 124/6 |
| 5,655,947 | 8/1997 | Chen | 446/46 |
| 5,816,879 | 10/1998 | Kyanne | 446/48 |
| 5,868,597 | 2/1999 | Chen | 446/46 |

*Primary Examiner*—John A. Ricci

*Attorney, Agent, or Firm*—Marshall, O'Toole, Gerstein, Murray & Borun

[57] ABSTRACT

A launcher for a ring airfoil includes a magazine assembly holding a plurality of ring airfoils. The magazine assembly is coupled to a launching mechanism, and the launching mechanism provides an indexing motion to the magazine assembly. In use, the setting action of the launching mechanism indexes the magazine assembly allowing a ring airfoil to engage with the launching mechanism for subsequent launching. Additional ring airfoils may be launched by repeated actuation of the launching mechanism without reloading the magazine assembly with ring airfoils.

20 Claims, 8 Drawing Sheets

REPEATER LAUNCHER AND RING AIRFOIL

FIELD OF THE INVENTION

The present invention relates generally to toy projectiles and launchers for toy projectiles, and more particularly, the present invention relates to a ring airfoil and an associated repeater launcher.

BACKGROUND OF THE INVENTION

Flying toys are and long have been favorites of children. The excitement of launching an object and watching it fly through the air continues to capture the imagination of youngsters. Being able to control and direct the flight of objects further adds to the amusement and attraction of these toys.

Ballistic type toy projectiles, such as darts, arrows, missiles and the like are common. A drawback of these toys is the inherent parabolic flight path, which limits both the distance of flight and accuracy. Toy projectiles that generate lift during flight overcome these limitations and have the ability to provide substantially level flight trajectory. U.S. patent application Ser. No.09/092,564, filed Jun. 5, 1998 and entitled "Ring Airfoil Launcher," the disclosure of which is hereby expressly incorporated herein by reference, describes a lift generating ring airfoil toy and a variety of launchers. The advantage of the ring airfoil is its ability to generate lift during flight offering the potential for substantially level flight over increased distances. Furthermore, the launchers disclosed therein are arranged to impart spin on the ring airfoil as it is launched. The spinning action enhances lift generation and gyro-stabilizes the ring airfoil on its flight path. As is appreciated, the ring airfoils and launchers disclosed in application Ser. No. 09/092,564 yield both increased flight distance and accuracy to target.

To reduce the likelihood of damage or injury upon impact of a ring airfoil with an object or person, application Ser. No. 09/092,564 teaches forming the ring airfoils from a thermoplastic elastomer with a hardness not exceeding 80 measured on the Shore A scale. The material must be rigid enough to permit the launcher to transfer launching energy to the ring airfoil, yet soft enough that the kinetic energy density for a given launch velocity, i.e., the kinetic energy of the ring airfoil at launch, is within industry guidelines. Kinetic energy density in a sense is a measure of energy per unit area upon impact. Softer materials expand upon impact increasing the surface area thereby reducing the energy per unit area and hence the kinetic energy density for a given amount of kinetic energy. Therefore, softer materials may be launched with higher velocity, i.e., more kinetic energy. Meanwhile, harder materials expand less upon impact and therefore have a higher kinetic energy density for a given amount of kinetic energy. Thus, ring airfoils made from harder materials must be launched with lower velocity, i.e., lower kinetic energy.

A soft material, however, may become deformed as energy is transferred from the launcher to the ring airfoil during launch. This deformation hinders the energy transfer. Furthermore, some deformation may remain during flight reducing the aerodynamic and gyro-stabilzing properties of the ring shape. These factors ultimately limit the amount of energy that may be effectively transferred from the ring launcher to the ring airfoil. The net result is shorter, less accurate flights. Forming the ring airfoil from harder materials, however, requires reducing the launch velocity, which again results in shorter flights. Also, molding the ring airfoil as a single piece typically limits the ring airfoil to a single color.

To achieve the desired flight characteristics, a ring airfoil launcher is designed to impart both rotational and translational launching energy to the ring airfoil. This creates a complex launching action requiring a complex launching mechanism. The launching mechanisms described in the application Ser. No. 09/092,564 are very effective for providing the required launching action. However, these mechanisms are limited to single launches and then require reloading.

SUMMARY OF THE INVENTION

In accordance with a preferred embodiment of the present invention a launcher for a ring airfoil includes a magazine assembly holding a plurality of ring airfoils. The magazine assembly is coupled to a launching mechanism, and the launching mechanism provides an indexing motion to the magazine assembly. In use, the setting action of the launching mechanism indexes the magazine assembly allowing a ring airfoil to be engaged with the launching mechanism for subsequent launching. Additional ring airfoils may be launched by repeated actuation of the launching mechanism without reloading the magazine assembly with ring airfoils until the magazine has been depleted.

In one aspect of the present invention, a launcher for annular flying rings includes a housing in which a magazine assembly formed with a plurality of cells is supported. Each cell is sized to receive a ring for launching from the launcher. A launching mechanism is secured within the housing, and the launching mechanism includes an indexing assembly coupled to the magazine assembly. The indexing assembly includes an indexing tab that engages a cam formed on the magazine assembly for selectively indexing the magazine through a plurality of positions. In each position one of the plurality of cells is aligned with a launch chuck. The launch chuck is moveable with respect to the magazine assembly to engage a ring disposed in the one cell, and the launch chuck is also coupled to a source of launching energy to launch the ring with both translational and rotational energy.

In another aspect of the present invention, a toy ring launcher includes a housing and a magazine assembly journally supported within the housing on an axle. The magazine assembly includes a cylinder supported on the axle, and the cylinder is formed to include a plurality of apertures disposed about its circumference. Each aperture is sized to receive a ring. The magazine assembly further has an indexing cam supported on and engaging the axle. A launching mechanism is secured within the housing and includes a barrel shaft slideable within the housing along a launching direction. The shaft has a first end and a second end, and the first end is formed with an axially extending helical slot. A collar is disposed over the first end and is axially slideable along the shaft. A launch chuck is also disposed over the first end and axially slideable along the shaft, and the launch chuck is further formed with a tab member engaging the slot. A spring is disposed between the collar and the launch chuck, and a retainer is secured to an axial end of the shaft for retaining the chuck, spring and collar on the shaft. An indexing assembly is slideable between a first position and a second position within the housing along the direction of flight. The indexing assembly has a tab engaging the collar for limiting sliding motion of the collar in a first direction, a latch engaging the launch chuck for limiting sliding motion of the launch chuck in a second direction and an indexing pin engaging the indexing cam. Movement of the shaft in the first direction engages the collar with the tab and further compresses the spring between the launch chuck and the collar. The spring is retained in the compressed state by engagement of the latch with the launch chuck. Movement of the shaft in the second direction engages the indexing pin with the indexing cam for indexing one of the plurality of cells to a launch position. Further movement of the shaft in the second direction engages the launch chuck with an annular ring disposed within the cell.

In yet another aspect of the present invention, a launcher and a plurality of ring airfoils are provided in combination, the ring airfoil is formed with a rigid body portion and an energy absorbing material disposed on a leading edge of the ring airfoil, and the launcher includes a magazine assembly retaining the plurality of ring airfoils and a launching mechanism coupled to the magazine assembly to selectively engage the ring airfoils and to launch the same.

DETAILED DESCRIPTION OF THE PREFERRED EMBODIMENTS

Figures 1, 4:
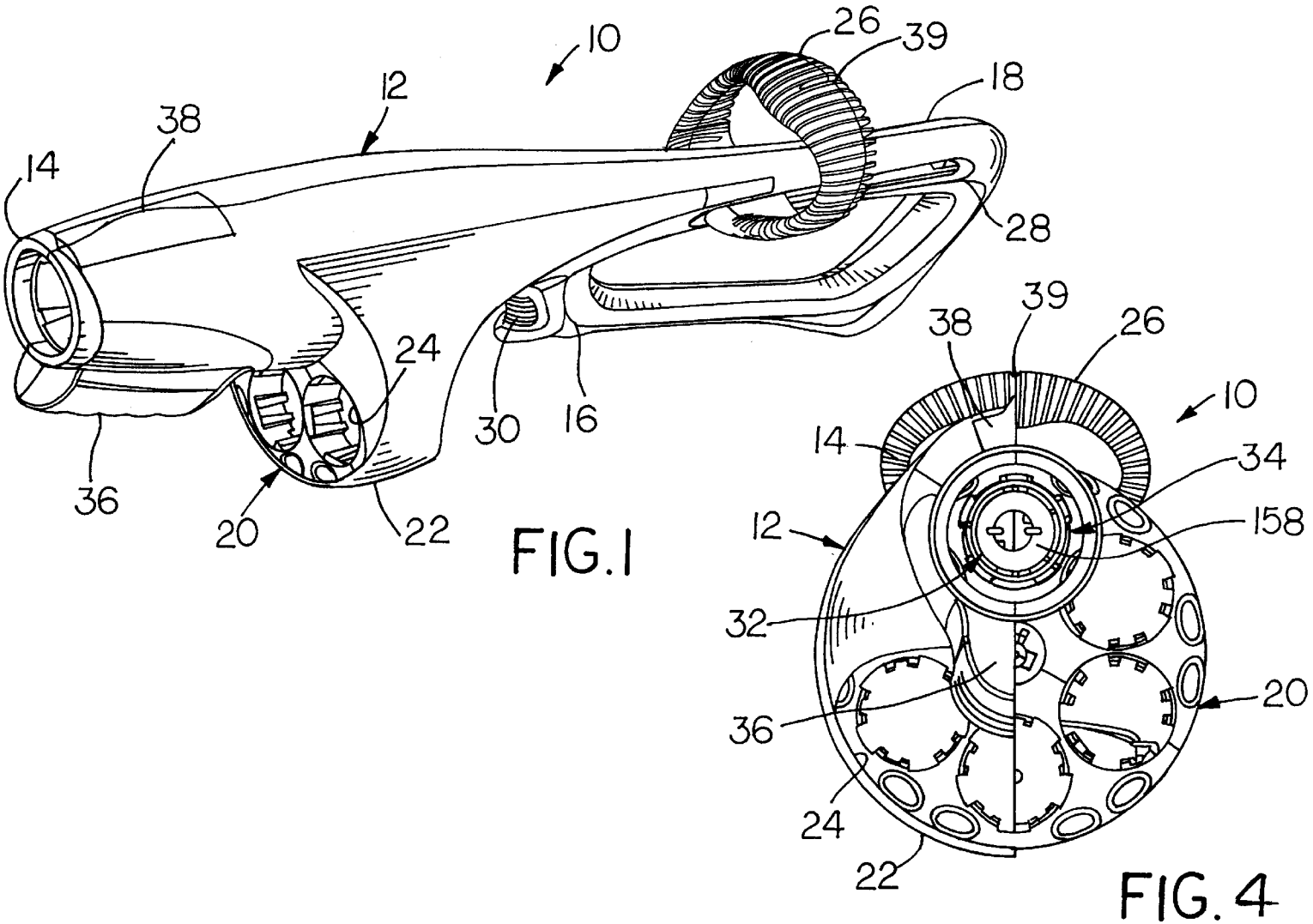
FIG. 1 is a perspective view of a ring launcher adapted for launching a plurality of ring airfoils in accordance with a preferred embodiments of the present invention.
FIG. 4 is a partially broken away side elevation view of the ring launcher illustrated in FIG. 1.
Figure 3:
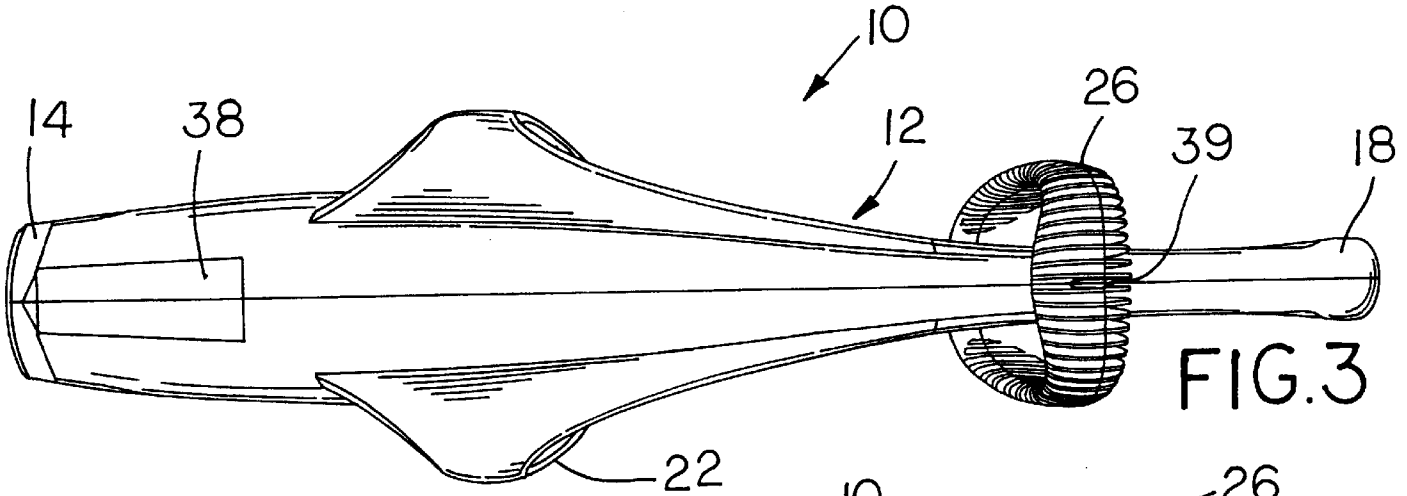
FIG. 3 is a plan view of the ring launcher illustrated in FIG. 1.
Figure 2:
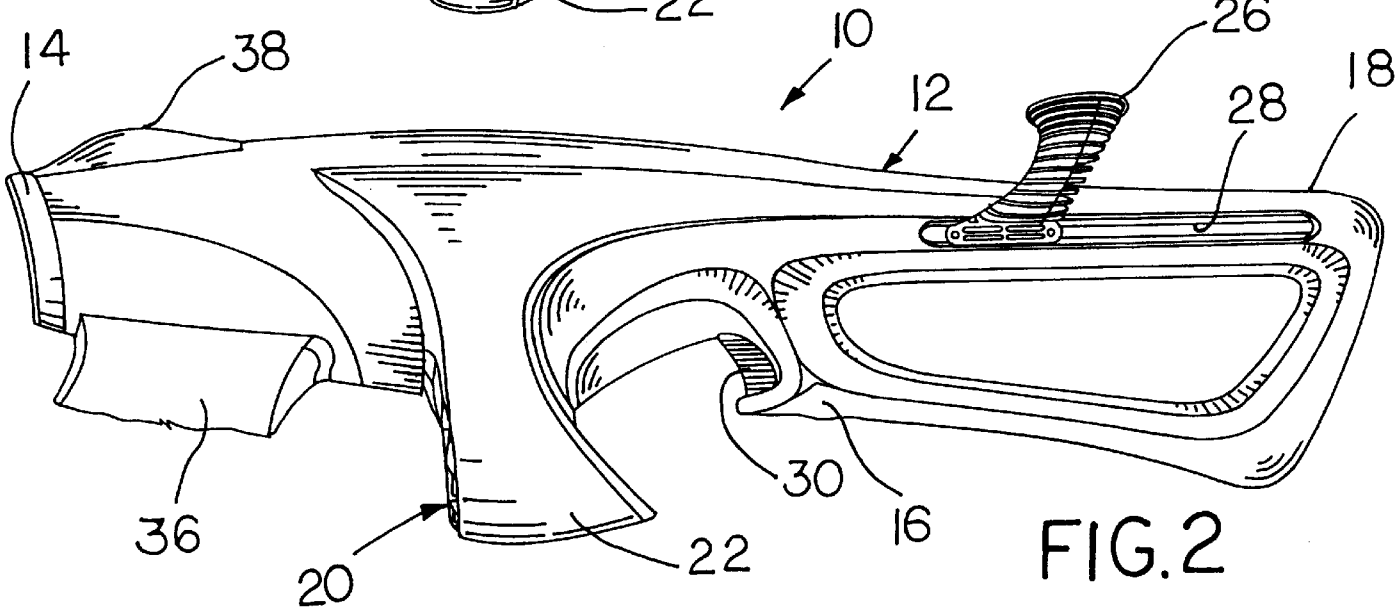
FIG. 2 is a front elevation view of the ring launcher illustrated in FIG. 1.

Referring to FIGS. 1–4, a ring launcher 10 is capable of launching a plurality of ring airfoils. An elongated housing 12 has a muzzle 14 formed at a forward end, a centrally located grip 16 and a rearwardly extending stock 18. A cylinder-type ring airfoil magazine assembly 20 is contained within a substantially cylindrical lower portion 22 of housing 12, which is formed to include an aperture 24 permitting the loading of ring airfoils into magazine assembly 20. Handle 26 slides in a slot 28 formed along stock 18 and couples to a launching mechanism 32 disposed within housing 12. A launch trigger 30 is operably disposed in grip 16 and is also coupled to launch mechanism 32. As will be described more fully below, drawing handle 26 rearward and moving it forward with respect to housing 12 sets and readies launching mechanism 32, while actuation of trigger 30 releases launching mechanism 32 for launching a ring airfoil 34. Launcher 10 further includes a forward grip 36 and a sight 38 formed on an upper surface of housing 12 and a rearward sight 39 formed in handle 26.

Figure 5:
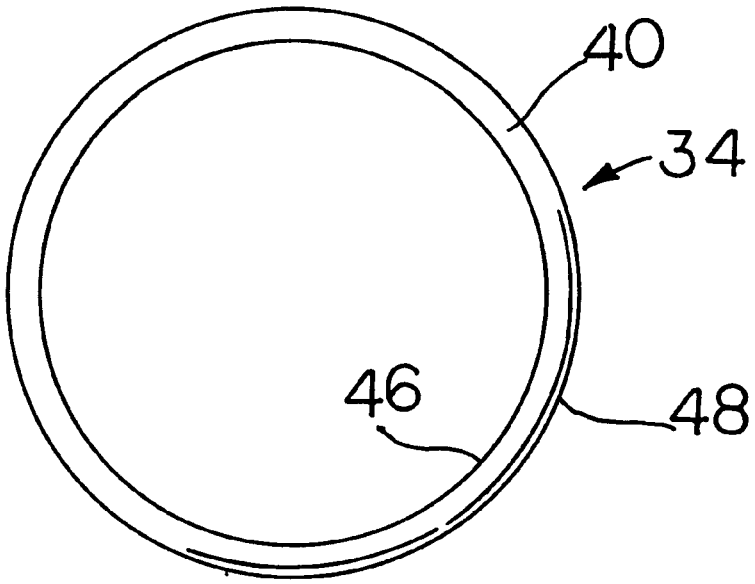
FIG. 5 is a front view of a ring airfoil according to a preferred embodiment of the present invention.
Figure 6:
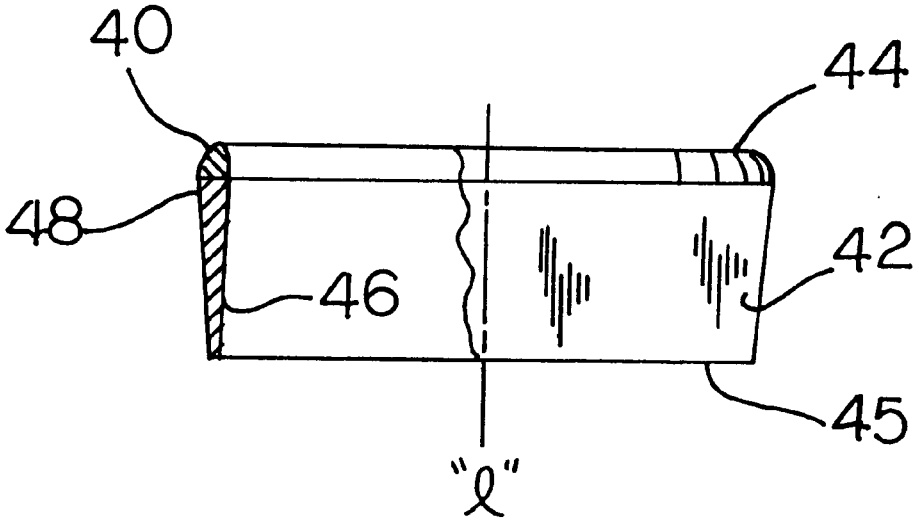
FIG. 6 is a side elevation view in partial cross-section of the ring airfoil illustrated in FIG. 5.
Figure 7:
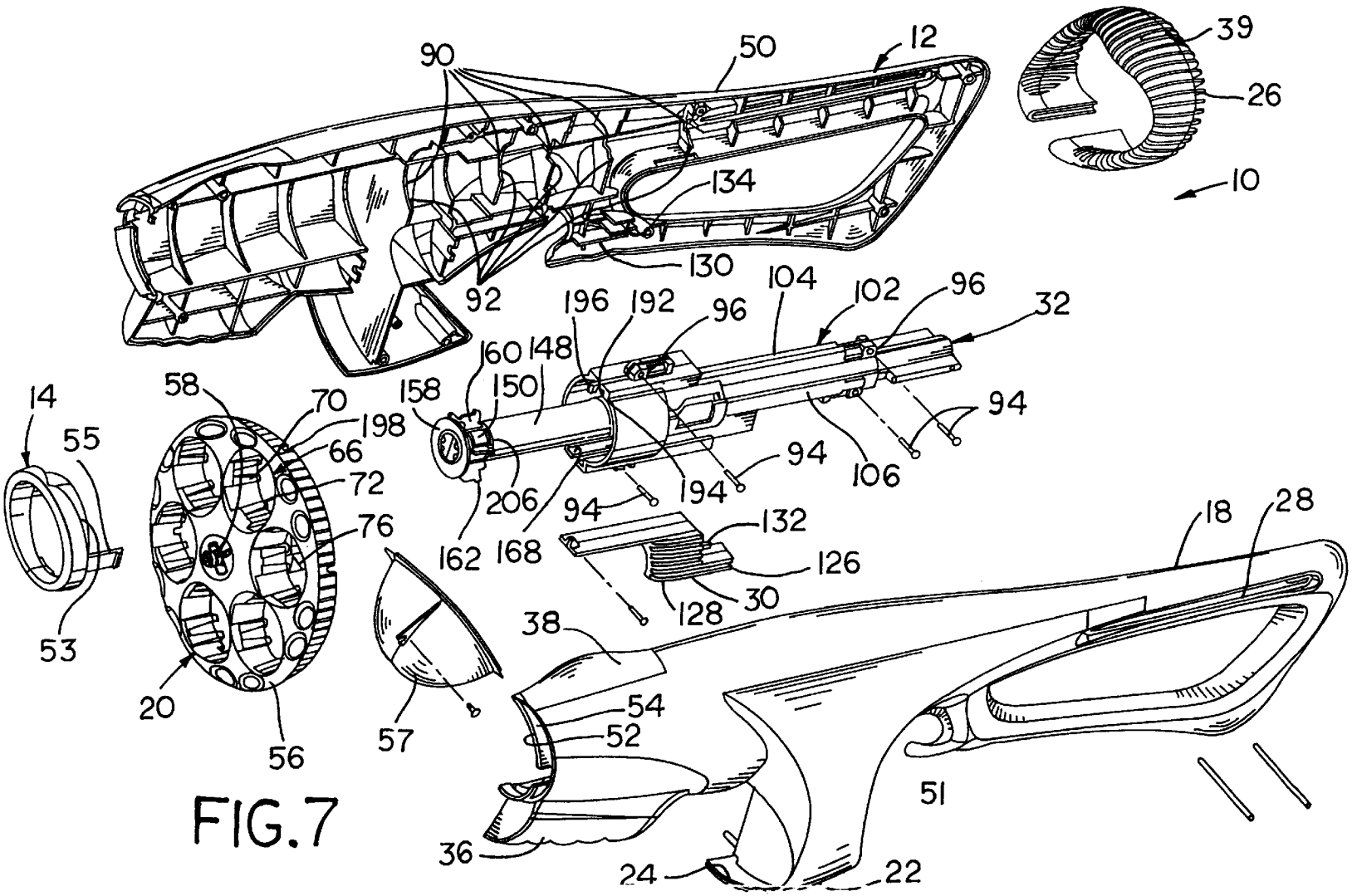
FIG. 7 is an expanded assembly view of the ring launcher illustrated in FIG. 1.

Referring to FIGS. 5–7, a ring airfoil 34 in accordance with a preferred embodiment of the present invention has a generally annular shape formed by the joining of a forward portion 40 and a rearward portion 42 (as used herein, the terms forward and rearward are referenced with respect to the intended launching direction and/or direction of flight of the ring airfoil). Forward portion 40 defines a leading edge 44 and rearward portion 42 defines a trailing edge 45, and ring airfoil 34 further includes an inner surface 46 and an outer surface 48. Leading edge 44 is preferably formed to a radius of about 3 mm to about 5 mm. Ring airfoil 34, in side elevation, FIG. 6, has a slightly frusto-conical configuration with outer surface 48 tapered inward toward central axis "1." Inner surface 46 is also angled and converges toward outer surface 48 as it extends rearwardly from leading edge 44. This airfoil like configuration of inner surface 46 and outer surface 48 enhances the lift generating properties of ring airfoil 34 during flight.

In further accordance with the present invention, forward portion 40 is formed from a first relatively soft material and rearward portion 42 is formed from a second relatively rigid material. More particulary, forward portion 40 may be formed from thermoplastic elastomer having a hardness not exceeding about 20 on the Shore A scale. Rearward portion 42 is also preferably formed from a thermoplastic elastomer but having a hardness ranging between about 40 and 80 on the Shore A scale. The harder material for rearward portion 42 helps ring airfoil 34 to better retain its shape particularly during launch. As a result, there is better energy transfer from launching mechanism 32 to ring airfoil 34. The harder material also helps to stabilize ring airfoil 34 during flight improving its aerodynamic characteristics.

The softer material for forward portion 40 expands upon impact absorbing energy and increasing the effective impact area. The combination of the improved energy absorption of the softer material with the increased impact area from the expansion of the material reduces the kinetic energy density per impact. It is desirable to reduce the kinetic energy density, and toy industry regulations establish guidelines in this area. Prior ring airfoils formed from a single material have been limited by kinetic energy density. This limited the total kinetic energy that could be input to the ring airfoil, and hence, limited the speed and distance of flight of the ring airfoil. By reducing the kinetic energy density for a given value of total kinetic energy, greater amounts of kinetic energy may be transferred to ring airfoil 34 during launch while still ensuring a desired kinetic energy density. In short, ring airfoil 34 makes farther, faster and straighter flights possible.

Rearward portion 42 is preferably molded, and then forward portion 40 is preferably molded onto rearward portion 42 forming ring airfoil 34. This ensures a strong permanent bond between forward portion 40 and rearward portion 42. Additionally, the two material construction for ring airfoil 34 allows for its manufacture in multiple colors. That is, rearward portion 42 may be molded in a first color and forward portion 40 molded in a second color. Multi-color toys attract the attention and imagination of children, and therefore are highly desired. In addition, the differing colors are instructional for identifying rearward portion 42, and hence which end of ring airfoil 34 should be first loaded onto launcher 10. It will be appreciated that while described as a multi-step molding process, other molding techniques, including multi-screw molding machines and shuttle molds may be used.

Referring now to FIGS. 7–10, launcher 10 is described in more detail. Housing 12 is preferably formed from first and second housing halves 50 and 51, respectively. Muzzle 14, is then secured within an opening 52 formed at the forward end of housing 12 by the joining of halves 50 and 51, and secures and retains the forward end of housing 12 together by the engagement of a lip portion 53 on muzzle 14 with a recess 54 on housing 12 and by engagement of tabs 55 within housing 12. Member 57 encloses a rearward side of lower portion 22. Muzzle 14 also advantageously permits coloring in compliance with regulations relating to toy projectile devices.

Launcher 10 provides for repeated launching of multiple ring airfoils 34. In this regard, magazine assembly 20 and launching mechanism 32 cooperate to permit launching of a plurality of ring airfoils 34 prior to having to reload launcher 10. Magazine assembly 20 includes a magazine cylinder 56 retained on a first end 58 of an axle 60. Axle 60 is formed with opposing, radially outwardly extending flanges 62 that engage a complimentary aperture 64 formed at a center of cylinder 56. Frictional engagement, snap engagement or a retaining clip fastener may be used to retain cylinder 56 to axle 60, and snap tabs 61 are shown which engage aperture 64. Cylinder 56 is formed to include a plurality of apertures, or cells 66, uniformly disposed about its circumference. Each cell 66 includes a plurality of axially extending ribs, one shown as 70, and each rib 70 includes a radially inwardly extending tab, one shown as 72. Ring airfoils 34 are received within cells 66. Ribs 70 and tabs 72 accurately position a ring airfoil 34 within a cell 66, and frictional engagement between ring airfoil 34 and ribs 70 retain it therein.

Disposed on a second end 74 of axle 60 is an indexing drum 76. Second end 74 is formed with a plurality of outwardly extending flanges 78 that engage a complimentary aperture 80 formed through drum 76. Drum 76 may be retained on axle 60 in a manner similar to cylinder 56. Drum 76 is formed to include a plurality of cam slots 82 in its outer surface 84. Magazine assembly 20 is journally supported on notches 86 formed in rib members 88 within housing 12.

Launching mechanism 32 is supported within recesses 90 formed in ribs 92 within housing 12. A plurality of threaded fasteners 94 are further provided for securing launching mechanism 32 within housing 12, wherein threaded fasteners 94 engage apertures 96 formed in launching mechanism 32 and thread into bosses 98 formed in housing 12.

Figure 9:
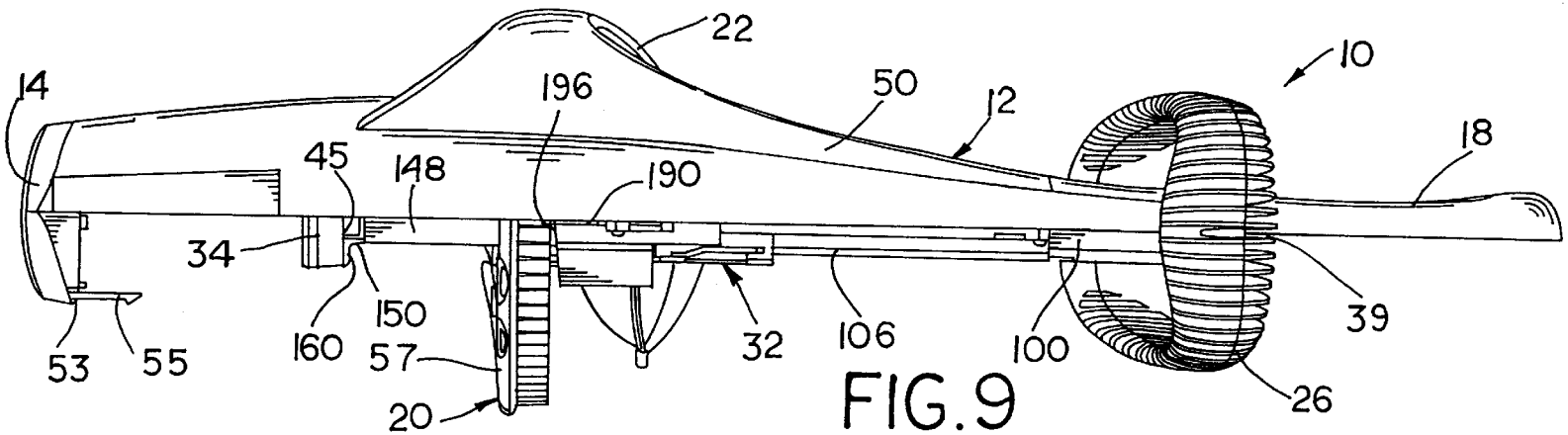
FIG. 9 is a partially broken away plan view of the ring launcher shown in FIG. 1.
Figure 8:
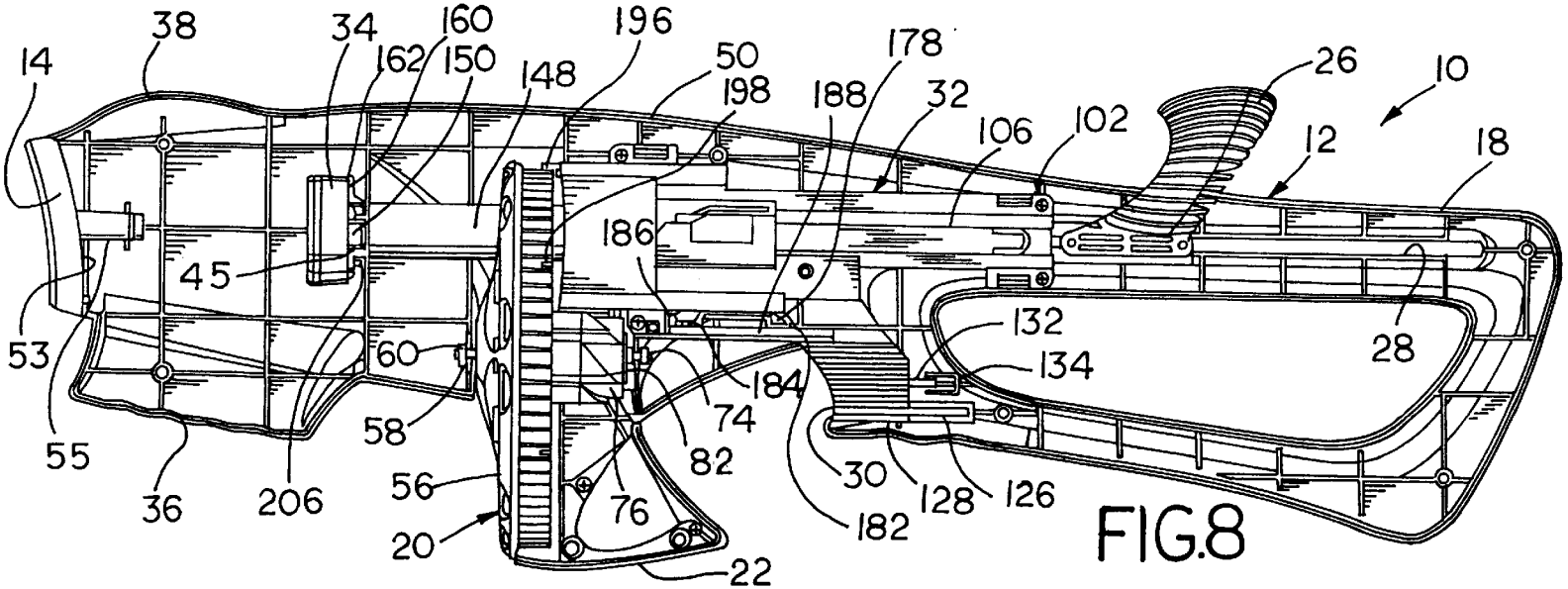
FIG. 8 is a partially broken away side elevation view of the ring launcher illustrated in FIG. 1.
Figure 10:
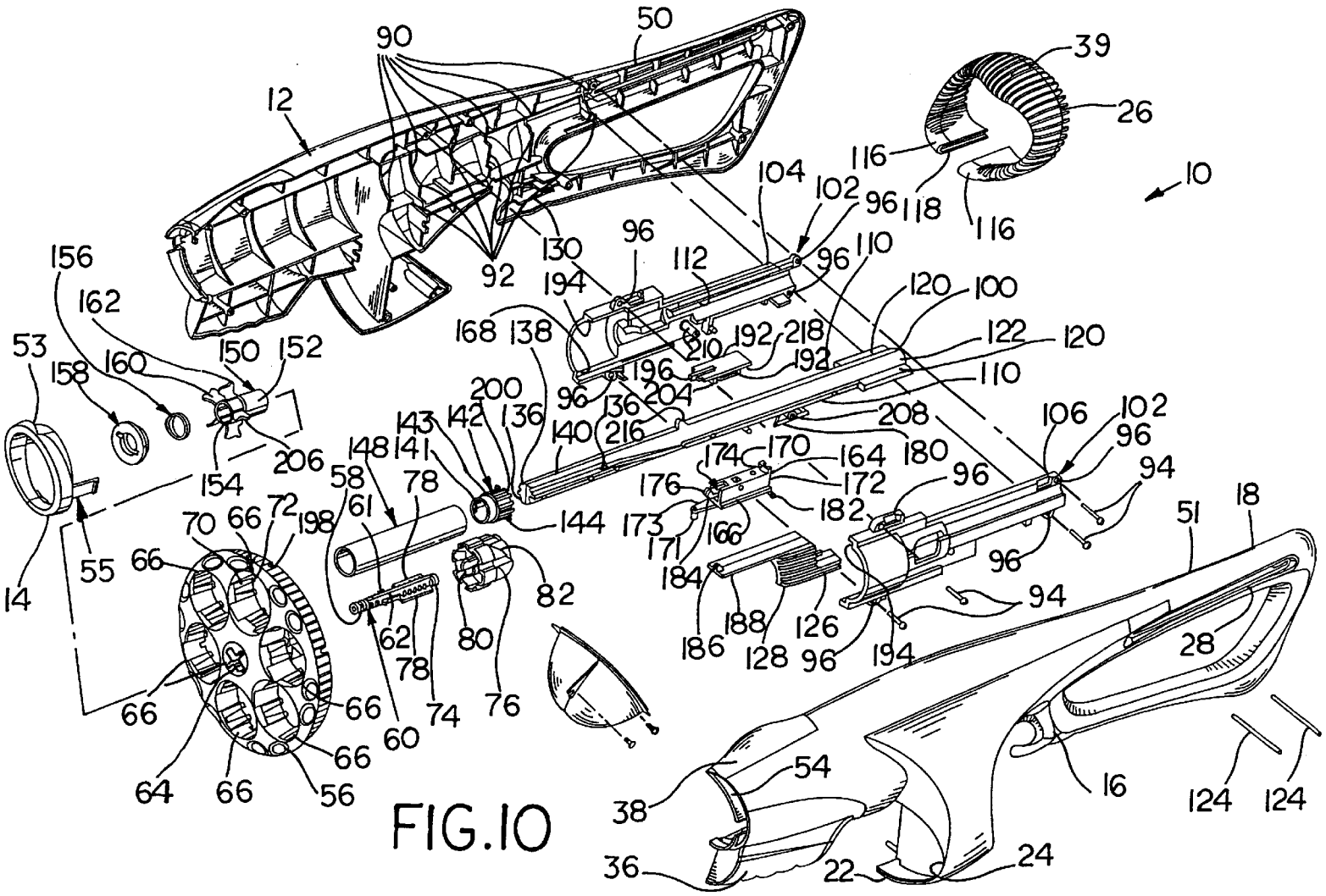
FIG. 10 is a further expanded assembly view of the ring launcher illustrated in FIG. 1.

With continued reference now to FIGS. 7–9 and particular reference to FIG. 10, launching mechanism 32 includes a barrel shaft 100 axially slideably received within a launching mechanism housing 102 formed from a first housing portion 104 and a second housing portion 106. Housing portions 104 and 106 are also secured together by threaded fasteners 94, but may be secured by snap tabs, sonic welding, adhesive bonding and the like. Shaft 100 includes a pair of axially extending flanges 110 that engage slots 112 formed respectively within first and second housing portions 104 and 106. Handle 26 has a "C" shape and its lower ends 116 are formed with slots 118. Lower ends 116 extend through slot 28 and engage flanges 120 formed at a rear portion 122 of shaft 100 and are retained thereto by dowel pins 124. Trigger 30 is retained within housing 12 by the engagement of slots 126 formed on each side of a lower portion 128 thereof with ribs 130 formed on halves 44 and 46. Trigger 30 is biased in a forward position by a spring (not shown) disposed over a pin 132 formed at a lower rear portion of trigger 30 and bearing against trigger 30 and against a spring pocket 134 formed in housing 12.

A forward end 140 of shaft 100 is formed with a first pair of slots, one slot each on respective sides of shaft 100 and each designated 136, and a second pair of slots, one each on respective sides of shaft 100 and each designated 138. Axially slidably disposed on forward end 140 is an annular collar 142. An inner diameter 141 of collar 142 is formed with a first pair of tabs (not shown) that engage first slots 136. An outer diameter 143 of collar 142 is formed with a second pair of tabs 144 that reference a pair of slots (not shown) formed on an inner surface of housing portions 104 and 106. The cooperation of the tabs within slots 136 and tabs 144 with the slots in housing portions 104 and 106 dictate the motion of collar 142 during operation of launcher 10.

Further secured over forward end 140 is a launch spring 148 (illustrated as a cylinder and preferably a metal coil spring) and a launch chuck 150. Chuck 150 includes a sleeve portion 152 having an inner diameter 154 in which a pair of tabs (not shown) are formed. The tabs engage slots 138. Slots 138 form a helical twist which causes a rotation of chuck 150 as it moves axially along shaft 100. Launch spring 148 bears between collar 142 and chuck 150, and chuck 150 is retained on forward end 140 by a bumper 156 and a retainer 158 that is secured to forward end 140. Chuck 150 is formed with a plurality of radially outwardly extending arms 160, that are adapted to engage inner surface 46 of a ring airfoil 34, and outwardly extending tabs 162 adapted to engage trailing edge 45 of ring airfoil 34.

Disposed within housing 102 and below shaft 100 is indexing assembly 164. Indexing assembly 164 includes outwardly extending flanges 166 that are slideably retained within slots 168 formed in housing portions 104 and 106. Indexing assembly 164 further includes an upwardly extending tab 170 at a rearward portion 172 thereof and a downwardly projecting indexing pin 171 on a forward extending flange 173. Pivotably supported within indexing assembly 164 is a trigger latch 174. Trigger latch 174 includes a upwardly extending locking clasp 176 at a forward portion and a downwardly extending triggering cam 178 at a rearward portion. Trigger latch 174 is biased by a spring (not shown) in an upward, latched position. Indexing assembly 164 is normally biased in a rearward position by a spring 180 coupled between indexing assembly 164 and a rearward portion of housing 102. In its forward position, shown in FIG. 10, a ramped surface 184 formed on trigger cam 178 is engaged with a trigger actuator tab 186 formed on a forwardly extending flange 188 of trigger 30.

Disposed within housing 102 and above shaft 100 is a cylinder lock 190. Cylinder lock 190 includes flanges 192 that are slideably received within slots 194 formed in housing portions 104 and 106. In a forward position, shown in FIG. 10, a forward extending tab 196 engages one of a plurality of slots 198 formed around a circumference of cylinder 56 preventing rotational movement of cylinder 56. In a rearward position (shown in FIG. 11) tab 196 is released from an engaged slot 198 permitting rotational movement of cylinder 56 for indexing of cells 66 during operation of launcher 10 and/or during indexing of cells 66 for loading ring airfoils 34.

Figure 11:
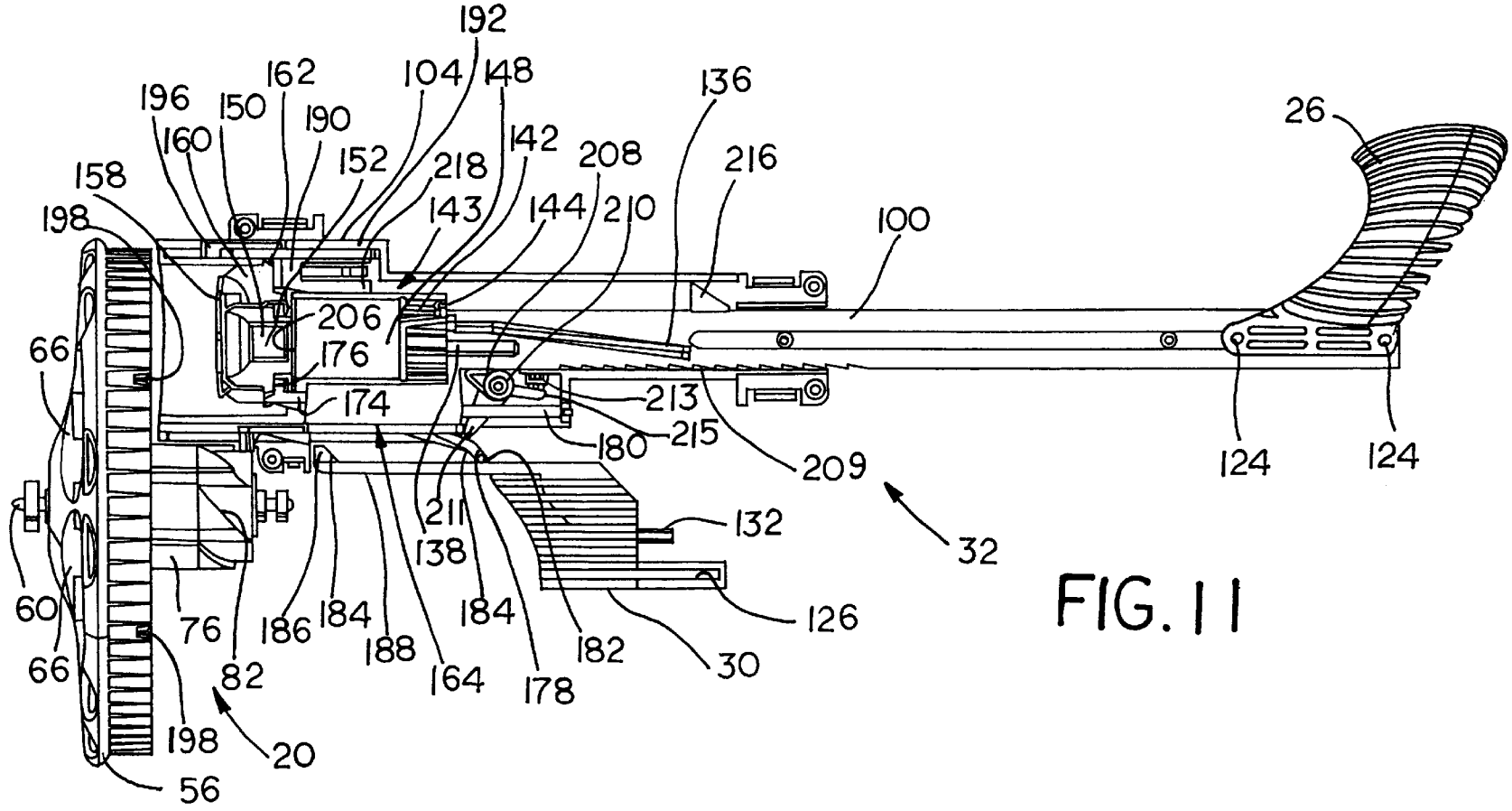
FIG. 11 is a partial side elevation view of the ring launcher shown in FIG. 1 with several of the housing portions removed.
Figure 12:
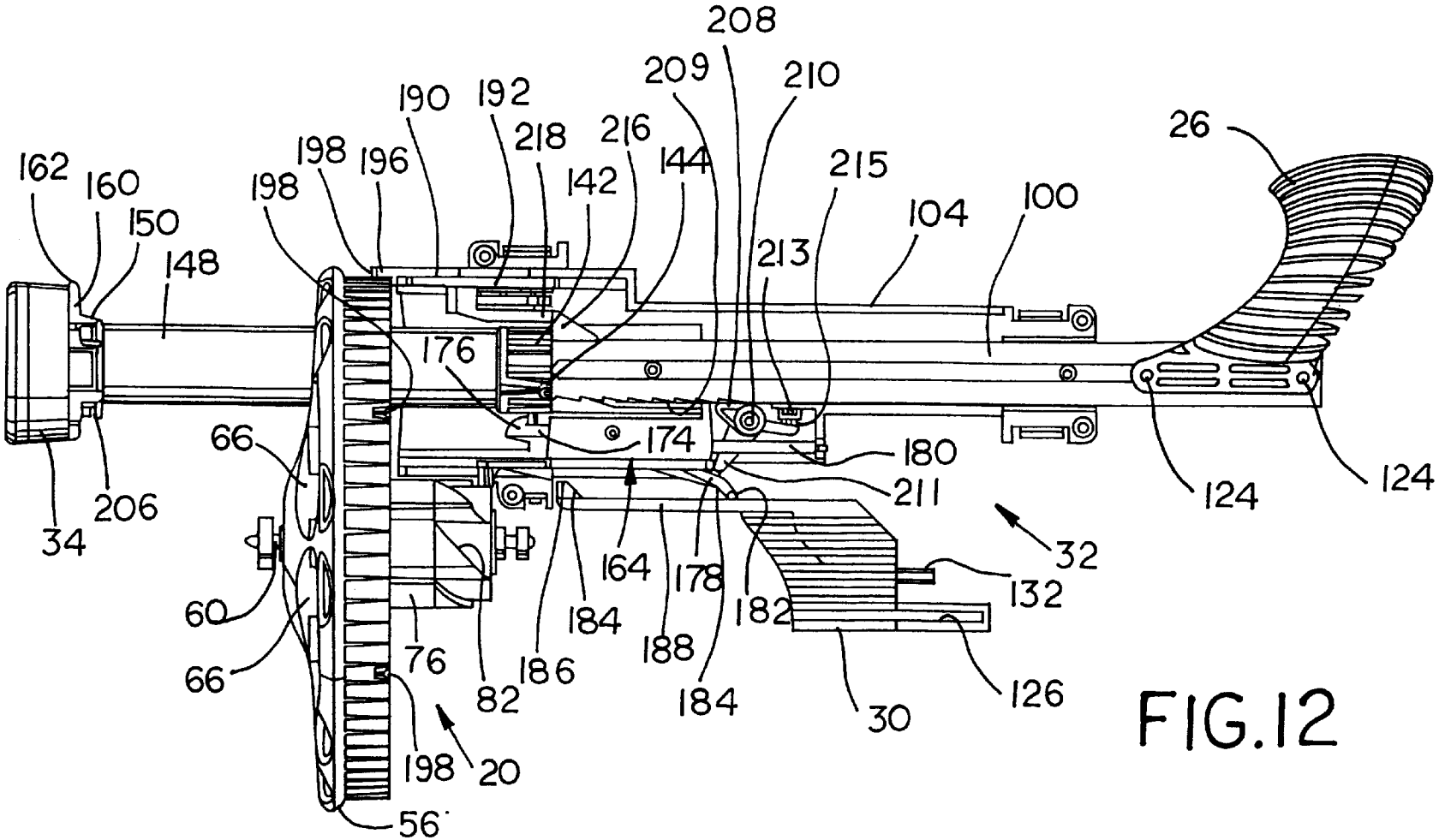
FIG. 12 is a view similar to FIG. 11 with the ring launcher shown in a second operative position.

With continued reference to FIGS. 7–10 and now also reference to FIGS. 11 and 12, further understanding of launcher 10, and particularly launching mechanism 32, will be derived from a description of its operation. In order to set launching mechanism 32, handle 26 is drawn rearward along slot 28, which draws shaft 100 rearward within housing 102 (FIG. 11). Initially, collar 142, spring 148 and chuck 150 move axially with shaft 100 until a rear surface 200 thereof contacts tab 170 on indexing assembly 164. Indexing assembly 164 will be in its rearwardly biased position with respect to housing 102. Further rearward movement of handle 26, and hence shaft 100 compresses spring 148 as chuck 150 is drawn toward collar 142. Chuck moves rearward of cylinder 56 and the vertically extending arm 160 of the plurality of arms 160, engages a flange 204 formed on a lower portion of cylinder lock 190 causing it to now also slide rearward thus disengaging tab 196 from its corresponding slot 198. Further rearward movement of chuck 150 brings an annular flange 206 thereof into engagement with locking clasp 176. At this point, spring 148 is fully compressed between collar 142 and chuck 150, and the release of cylinder lock 190 permits free rotation of cylinder 56. What has also occurred is that collar 142 has rotated by engagement of tabs 144 with its respective slots to where it is clutched to the shaft 100. At this point, both indexing assembly 164 and cylinder lock 190 are disengaged from magazine assembly 20, and it may be freely rotated to facilitate loading of ring airfoils 34 into cells 66 through aperture 24.

Shaft 100 is now advanced within the housing, moving the cocked assembly group 143 including collar 142, chuck 150, spring 148 and indexing assembly 164 forward. Continued forward motion engages the indexing tab 171 with cam slots 82 on drum 76 to rotate magazine assembly 20 positioning a cell 66 in alignment with shaft 100. As shaft 100 is further advanced, tabs 144 and the slots on housing portions 104 and 106 rotate collar 142 out of its clutched position with respect to shaft 100. Shaft 100 may now continue sliding forward, but the motion of collar 142 by the engagement of the tabs with slots 136 and the engagement of tabs 144 with the slots in housing portions 104 and 106 cause the cocked assembly group 143 to advance more slowly. Chuck 150 therefore gradually advances and engages a ring airfoil 34 disposed within the aligned cell 66, which ensures ring airfoil 34 properly engages chuck 150 for launch.

An additional feature of shaft 100 is the formation on and underside thereof of ratchet teeth 209. A pawl 208 is pivotably supported on a pin 210 formed in housing 102. With indexing assembly 164 in its rearward biased position, indexing assembly 164 bears against an arm 211 causing pawl 208 to disengage from ratchet teeth 209. As the cocked assembly group 143 is advanced forward and out of engagement with arm 211, pawl 208 is biased against ratchet teeth 209 by a spring (not shown) bearing against tabs 213 and 215. Pawl 208 prevents shaft 100 from being drawn rearward after chuck 150 has engaged a ring airfoil 34. Shaft 100 may be moved forwardly and backwardly at its rearmost movement to permit shuttling through empty cells 66, however, once shaft 100 has been advanced too far forward, it must be moved fully forward and cocked assembly group 143 released before it may be pulled back. Releasing cocked assembly group 143 permits indexing assembly 164 to return to its rearward biased position and to thus release pawl 208 from ratchet teeth 209.

Upon further forward movement of shaft 100, a tab 216 on shaft 100 engages a rear portion 218 of cylinder lock 190. This urges cylinder lock 190 forward and engages tab 196 with a slot 198 on cylinder 56 locking cylinder 56 from further rotational motion. Also, forward movement of shaft 100 after engagement of chuck 150 with a ring airfoil 34 advances shaft 100 through chuck 150. Shaft 100 is now advanced fully forward to a ready or launch position. A portion of chuck 150 remains within cell 66, and locking clasp 176 is also now disposed within cell 66 between ribs 70.

Rearward movement of trigger 30 engages trigger actuator 186 with triggering cam 178 actuating trigger latch 174 and releasing locking clasp 176 from chuck 150. Spring 148 urges chuck 150 forward along shaft 100, and the engagement of the tabs within sleeve 152 with slots 138 cause a rotation of chuck 150. This imparts both linear and rotational energy to ring airfoil 34 thereby launching it from launcher 10. Chuck 150 and spring 148 are shown in the after launch, fully extended position in FIGS. 7–9 and 12.

Repeated operation of handle 26 and trigger 30 permits the successive launching of each of the ring airfoils 34 retained in magazine assembly 20. To prevent premature release of locking clasp 176, triggering cam 178 is formed with a pair of pins 182 (only one shown) extending laterally outwardly. Pins 182 engage flanges (not shown) formed in the sides of housing portions 104 and 106 which restrict its movement if the indexing assembly 164 is not in either its fully forward or fully rearward positions.

The present invention has been described in terms of several preferred embodiments for a ring airfoil and a launcher for a ring airfoil. More particularly, a two piece ring airfoil that may be launched with greater energy without increasing energy density upon impact is described. Additionally, a repeat action launcher 10 is described. The foregoing description of the preferred embodiments should therefore be taken as descriptive and not limiting of the invention, and the true scope of the invention judged from the subjoined claims.

We claim:

1. A launcher for annular flying rings, each ring having an inner diameter and an outer diameter, and the launcher comprising:

a housing;

a magazine assembly supported within the housing and formed with a plurality of cells, each cell sized to receive an annular flying ring for launching from the launcher;

a launching mechanism secured within the housing, the launching mechanism comprising an indexing assembly coupled to the magazine assembly and including an indexing tab that engages a cam formed on the magazine assembly for selectively indexing the magazine through a plurality of positions, wherein in each position one of the plurality of cells is aligned with a launch chuck, and the launch chuck moveable with respect to the magazine assembly to engage a ring disposed in the one cell, the launch chuck further coupled to a source of launching energy to launch the ring with both translational and rotational energy.

2. The launcher of claim 1, wherein the source of launching energy comprises a spring compressed between the launch chuck and a collar and the indexing assembly further comprises a latch that engages the launch chuck when the spring is compressed and releases from the chuck for launching the ring.

3. The launcher of claim 2, further comprising a trigger supported within the housing and accessible from an exterior portion of the housing, the trigger coupled to the indexing assembly for selectively releasing the latch from the launch chuck.

4. The launcher of claim 1, wherein the launch chuck includes a tab member that engages a guide, the guide defining a helical path wherein the launch chuck rotates and translates with respect to the guide under the urging of the source of launching energy.

5. The launcher of claim 4, wherein the guide comprises a shaft formed with a slot, the slot having a helical twist and the launch chuck comprises a sleeve formed with a tab, the sleeve disposed over the shaft and the tab engaging the slot.

6. The launcher of claim 1, wherein the magazine assembly comprises a cylinder, and the cells comprise apertures formed about a circumference of the cylinder, the cylinder being support on and engaged by an axle and the axle being journally supported within the housing.

7. The launcher of claim 6, the cam comprising a drum supported on and engaging the axle and including a plurality of cam slots formed in an outer surface thereof.

8. The launcher of claim 1, further comprising a handle disposed on an exterior portion of the housing and coupled to the launching mechanism, the handle being moveable between a first position and a second position for operating the launching mechanism.

9. The launcher of claim 1, wherein the rotational energy causes rotation of the annular flying ring about a central axis, the central axis being substantially aligned with a direction of flight, and the translational energy causes translation of the annular flying ring along the direction of flight.

10. A toy comprising a launcher according to claim 1 and a plurality of annular flying rings, each annular flying ring having an annular body portion formed from a first material having a first hardness and a leading edge portion formed from a second material having a second hardness, less than the first hardness.

11. A toy ring launcher comprising:

a housing;

a magazine assembly journally supported within the housing on an axle and comprising:

a cylinder supported on the axle, the cylinder formed to include a plurality of apertures disposed about its circumference and each aperture sized to receive a ring;

an indexing cam supported on and engaging the axle;

a launching mechanism secured within the housing and comprising:

a barrel shaft slideable within the housing along a launching direction, the shaft having a first end and a second end, the first end formed with an axially extending helical slot, a collar disposed over the first end and axially slideable along the shaft, a launch chuck disposed over the first end and axially slideable along the shaft, the launch chuck further formed with a tab member engaging the slot, a spring disposed over the shaft and between the collar and the launch chuck, a retainer secured to an axial end of the shaft for retaining the chuck, spring and collar on the shaft, and an indexing assembly slideable between a first position and a second position within the housing along the direction of flight and comprising a tab engaging the collar for limiting sliding motion of the collar in a first direction, a latch engaging the launch chuck for limiting sliding motion of the launch chuck in a second direction and an indexing pin engaging the indexing cam, and wherein movement of the shaft in the first direction engages the collar with the tab and further compresses the spring between the launch chuck and the collar, the spring retained in a compressed state by engagement of the latch with the launch chuck, and movement of the shaft in the second direction engages the indexing pin with the indexing cam for indexing one of the plurality of cells to a launch position and the launch chuck with an annular ring disposed within the one cell.

12. The launcher of claim 11, further comprising a trigger slidable within the housing and accessible from an exterior portion thereof, the trigger including a trigger actuator coupled to the latch for releasing the latch from the chuck to effect launching of the ring.

13. The launcher of claim 11, further comprising a cylinder lock slideable within the housing along the direction of flight, the cylinder lock engaged by a tab formed on the shaft in the first direction for engaging the cylinder lock with cylinder and by the launch chuck in the second direction for releasing the cylinder lock from the cylinder.

14. The launcher of claim 11, further comprising a handle, disposed on an exterior portion of the housing and coupled to the shaft.

15. The launcher of claim 11, wherein each of the plurality of apertures comprises a plurality of ribs disposed about a circumference of the aperture and a tab extending radially inwardly from each of the plurality of ribs.

16. The launcher of claim 11, the shaft further comprising a second slot, the second slot having a linear portion and a helical portion, the housing further comprising a third slot and the collar further comprising a first tab engaging the second slot and a second tab engaging the third slot.

17. The launcher of claim 11, further comprising a pawl pivotably supported within the housing and engaging a plurality of ratchet teeth formed in the shaft.

18. The launcher of claim 11, the launch chuck comprising a plurality of radially outwardly extending arms sized to engage an inner diameter of a ring.

19. The launcher of claim 11, the indexing cam comprising a drum supported on and engaging the axle, the drum formed with a plurality of cam slots in an outer surface.

20. A toy comprising a ring launcher in accordance with claim 11 and a plurality of annular flying rings, each annular flying ring having an annular body portion formed from a first material having a first hardness and a leading edge portion formed from a second material having a second hardness, less than the first hardness.

* * * * *